United States Patent [19]

Manis et al.

[11] 4,159,768

[45] Jul. 3, 1979

[54] FOLDABLE DEVICE FOR SUPPORTING A REEL

[75] Inventors: Charles A. Manis, Arlington; Gary B. Overcash, Haltom City, both of Tex.

[73] Assignee: Packaging Corporation of America, Evanston, Ill.

[21] Appl. No.: 931,858

[22] Filed: Aug. 7, 1978

Related U.S. Application Data

[63] Continuation of Ser. No. 605,769, Aug. 18, 1975, abandoned.

[51] Int. Cl.[2] ..... B65D 85/02; B65D 85/67

[52] U.S. Cl. ..... 206/396; 206/303; 206/493

[58] Field of Search ..... 206/45.14, 45.19, 149, 206/303, 304, 307, 309, 310, 389, 391, 392, 394, 395, 396, 397, 444, 472, 477, 482, 491, 493, 525; 108/55; 248/174

[56] References Cited

U.S. PATENT DOCUMENTS

| | | | |
|---|---|---|---|
| Re. 20,899 | 10/1938 | Scholl | 206/482 X |
| 1,852,922 | 4/1932 | Driver | 206/482 |
| 2,660,296 | 11/1953 | Dunning | 206/396 |
| 2,700,463 | 1/1955 | McCormick | 206/303 X |
| 2,765,907 | 10/1956 | Dunning et al. | 206/396 |
| 2,873,025 | 2/1959 | Rollie | 206/396 X |
| 2,879,022 | 3/1959 | Hennessey et al. | 248/174 |
| 3,156,404 | 11/1964 | Wood | 206/149 X |
| 3,233,728 | 2/1966 | Johnson et al. | 206/395 |
| 3,401,792 | 9/1968 | Tolaas | 206/396 |
| 3,621,995 | 11/1971 | Francis | 206/493 X |
| 3,931,889 | 1/1976 | Roccaforte | 206/493 |

FOREIGN PATENT DOCUMENTS

| | | | |
|---|---|---|---|
| 1258336 | 3/1961 | France | 206/392 |
| 396689 | 7/1933 | United Kingdom | 206/394 |

*Primary Examiner*—Stephen Marcus

*Attorney, Agent, or Firm*—Neuman, Williams, Anderson & Olson

[57] ABSTRACT

A foldable device formed from a blank of sheet material is provided for supporting a reel having a hub opening. The device includes a pair of foldably connected panels between which the reel is sandwiched. The first panel is provided with struck-out elements which are folded into overlapping relation to form a protuberance. The protuberance is adapted to snugly fit within the hub opening of the reel when the latter is sandwiched between the panels.

8 Claims, 7 Drawing Figures

FIG. 1
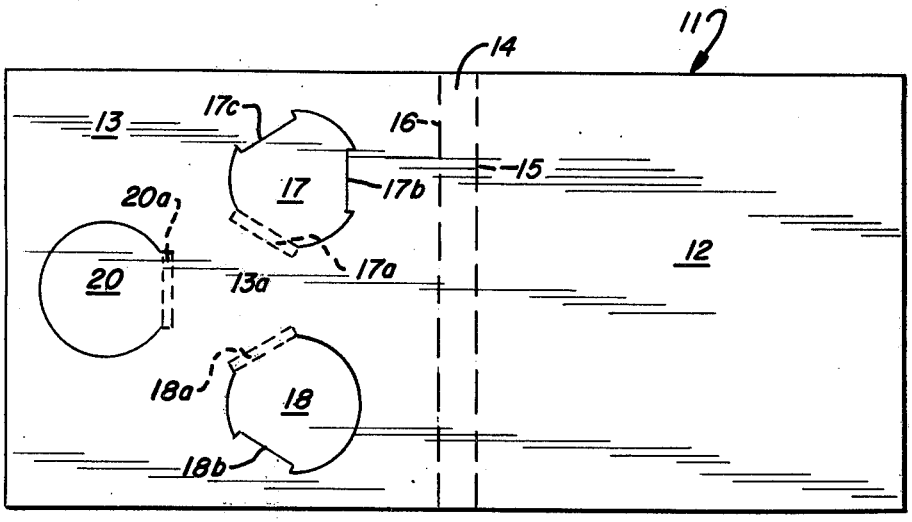
FIG. 2
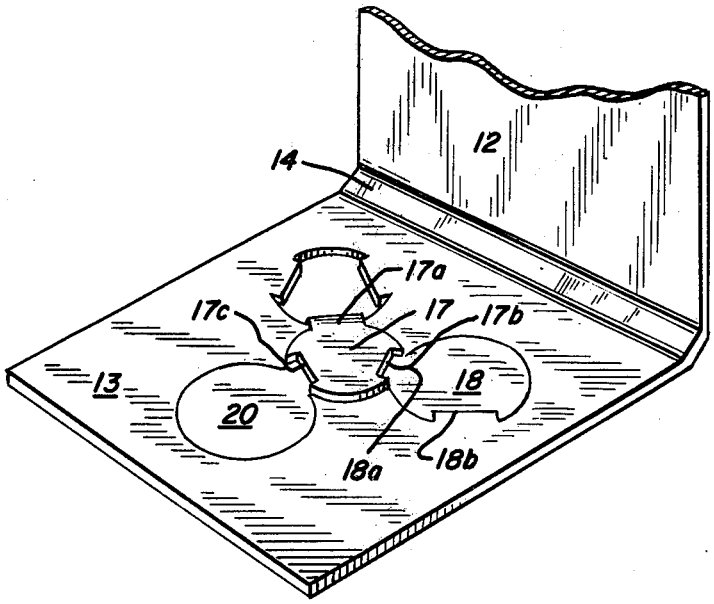
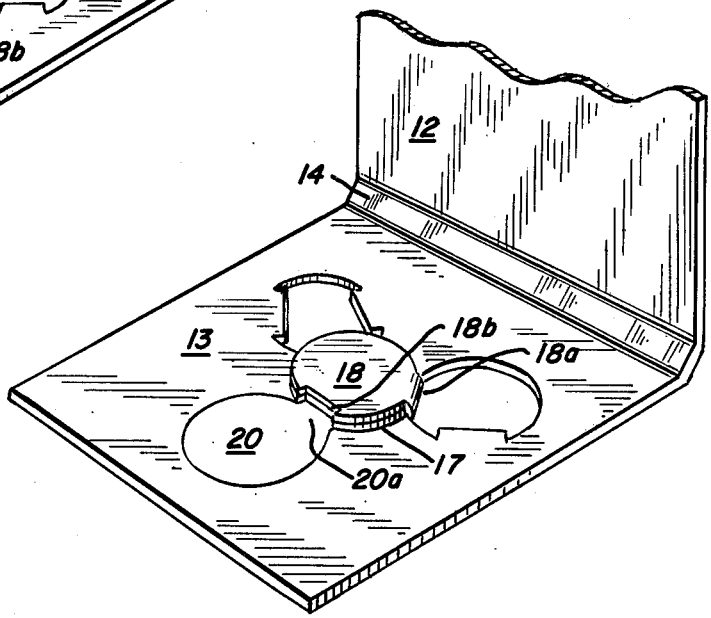
FIG. 3

FIG. 4
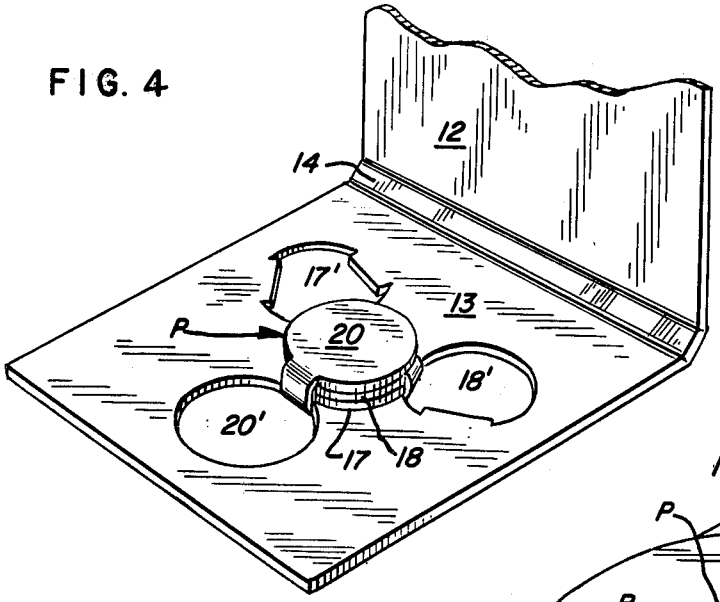
FIG. 5
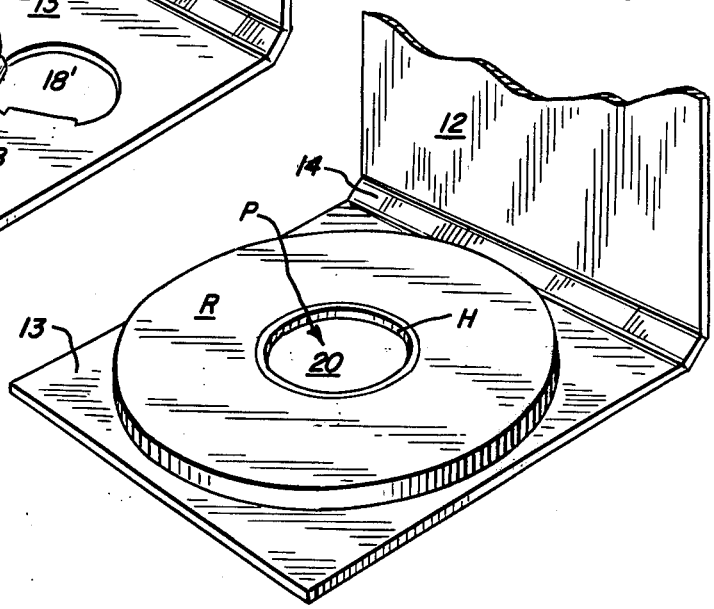
FIG. 6
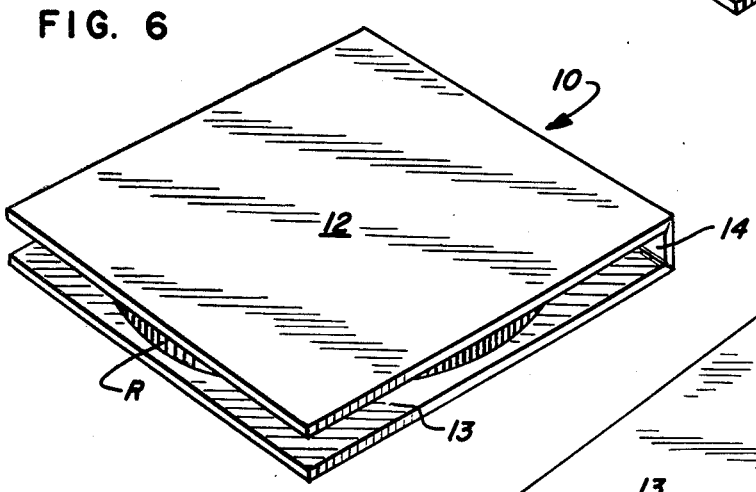
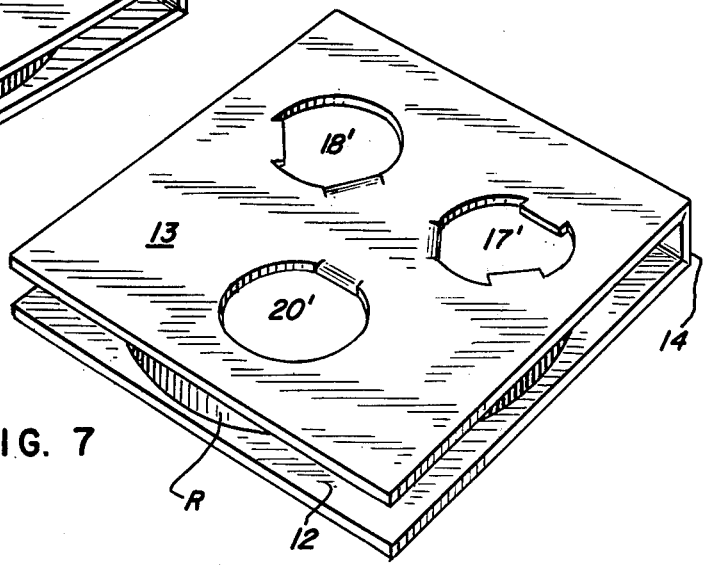
FIG. 7

FOLDABLE DEVICE FOR SUPPORTING A REEL

This is a continuation of application Ser. No. 605,769 filed Aug. 18, 1975, now abandoned.

BACKGROUND OF THE INVENTION

Heretofore in the supporting of reels, such as those utilized for computer magnetic tapes, it has been customary to dispose each reel in a suitable folder and then to insert a plastic or metallic hub through a die-cut opening in the folder and into the hub opening of the reel. Once the hub is in place, the folder is edge packed with similar folders in a master container of conventional design. The cost of the hub itself and the need to inventory a large number of such hubs and folders have rendered such a practice undesirable.

SUMMARY OF THE INVENTION

Thus, it is an object of the invention to provide a foldable device of unitary construction which functions as a support and folder for a reel.

It is a further object of the invention to provide a device of the type described formed from a single blank of inexpensive sheet material which, when not in use, may assume a planar condition suitable for storage.

It is a still further object of the invention to provide a device of the type described formed from a blank of foldable sheet material and which may be readily set up for use, when desired, without requiring tools or special equipment.

It is a still further object of the invention to provide a device of the type described which affords effective protection for the reel and the tape wound thereon.

It is a still further object of the invention to provide a device of the type described which is capable of accommodating a variety of types of reels.

It is a still further object of the invention to provide a device of the type described which is of simple, compact and light-weight construction and may be readily reused when desired.

Further and additional objects will appear from the description, accompanying drawings, and appended claims.

In accordance with one embodiment of the invention, a device is provided which is formed from a blank of foldable sheet material and is adapted to be used in supporting and providing protection for a reel of the type used to accommodate computer magnetic tape or the like. The reel is provided with a hub opening. The device includes a pair of panels foldably connected to one another and between which the reel is sandwiched. One of the panels is provided with a plurality of struck-out elements which are disposed in overlapping relation and form a protuberance, the latter being snugly inserted into the reel hub opening when the reel is sandwiched between the panels.

DESCRIPTION

For a more complete understanding of the invention reference should be made to the drawings wherein FIG. 1 is a top plan view of a blank from which one embodiment of the improved device is formed.

FIGS. 2–4 are fragmentary perspective views of the blank of FIG. 1 shown in successive stages of set-up.

FIG. 5 is a fragmentary perspective view similar to FIG. 4 but showing a reel positioned on a panel with the protuberance of the panel snugly accommodated within the hub opening of the reel.

FIG. 6 is similar to FIG. 5 but showing the reel sandwiched between the folded panels of the device.

FIG. 7 is similar to FIG. 6 but showing the device in an inverted position.

Referring now to the drawings and more particularly to FIG. 6, one embodiment 10 of a foldable device is shown, fully set-up, for accommodating a reel R, the latter being of a type used to hold computer magnetic tape or the like. The reel R is provided with a large hub opening H, see FIG. 5. The reel, when accommodated by the device 10, is normally filed in either side-by-side or edge-to-edge relation in a master storage container, not shown.

Device 10 is formed from a single blank 11 of foldable sheet material (e.g. double face corrugated board), see FIG. 1. The blank 11 includes a pair of panels 12 and 13 which are foldably connected to one another by way of an elongated narrow intermediate section or panel 14. Panels 12 and 13 are the same or similar in configuration and are of such size that they will extend beyond the periphery of the reel when the latter is sandwiched therebetween, see FIG. 6.

The foldlines 15 and 16 connecting panels 12 and 13, respectively to intermediate section 14, are disposed in spaced parallel relation. The spacing between foldines 15 and 16 corresponds substantially to the thickness of the reel R.

Panel 13, as seen in FIG. 1, is provided with three struck-out elements 17, 18 and 20, which are symmetrically arranged about the center axis of panel 13 and are adapted to be folded relative to one another to form a protuberance P on the interior surface of the panel 13, see FIG. 4. A corresponding peripheral portion **17*a*, 18*a* or 20*a* of each element remains foldably connected to panel 13** for reasons to be hereinafter described.

When the blank 11 is set up to accommodate a reel, struck-out element 17 is first folded about portion **17*a* so as to overlie a central portion 13*a* of the interior surface of panel 13, see FIG. 2. Subsequent to element 17 assuming a folded position (FIG. 2), element 18 is similarly folded about portion 18*a* so that it overlies previously folded element 17, see FIG. 3. In a like manner, element 20 is then folded about portion 20*a* so as to overlie previously folded element 18, see FIG. 4**.

It will be noted that the periphery of element 17 is provided with a pair of annularly spaced recesses **17*b* and 17*c* which are adapted to be aligned with the peripheral portions 18*a* and 20*a*, respectively, of elements 18 and 20 when the latter are folded into overlapping relation to form protuberance P. It will be further noted that element 18 is provided with a single peripheral recess 18*b* which is aligned with portion 20*a* of element 20 when the protuberance is formed. Recesses 17*c* and 18*b* are disposed in superposed relation when the protuberance is formed. The protuberance P will project from the interior surface of panel 13 by an amount equal to the sum of the thicknesses of the struck-out elements forming the protuberance. While the illustrated embodiment 10** discloses a protuberance formed of three overlapping elements, the number of elements forming the protuberance may be increased or decreased as desired. Furthermore, the shape of the elements forming the protuberance may be varied as desired and will depend upon the size and configuration of the hub opening. In addition, the recesses provided in the peripheries of certain of the struck-out elements may be of a chord-like configuration.

As seen in FIG. 7, when the reel is sandwiched between panels 12 and 13 and the struck-out elements 17, 18 and 20 have been folded so as to form the protuberance P, openings 17', 18' and 20' are formed in panel 13, which enable one to readily determine whether the reel is in place without unfolding the panels.

It will be noted that no special tool or equipment is required in setting up the device for use, but such setting up may be readily done manually. Furthermore, no adhesive or staples are required in setting up the device, thereby enabling same to be readily unfolded, when required, for storage in a planar condition and ready for reuse when required.

Thus, it will be seen that a simple, inexpensive and effective device has been provided which is readily capable of supporting a reel. The size and configuration of the device may be varied and will depend in part upon the shape, size and number of reels to be accommodated by the device.

We claim:

1. A foldable support for a reel having a hub opening, comprising a panel, and a plurality of struck-out elements foldably connected to said panel and disposed in face-to-face overlapping stacked relation relative to each other and to one surface of said panel and forming a protuberance projecting from said panel one surface and disposed within the periphery thereof, said protuberance being adapted to extend into the hub opening when the reel overlies the panel one surface.

2. A foldable support for a reel having a hub opening, comprising a first panel, and a second panel foldably connected thereto and between which the reel is adapted to be sandwiched; said first panel being provided with a plurality of spaced struck-out elements disposed in face-to-face overlapping stacked relation relative to each other and to said first panel and forming a protuberance for projecting into the reel hub opening when the reel is sandwiched between the panels.

3. The support of claim 1 wherein corresponding peripheral portions of said first and second panels are foldably interconnected to an intermediate section; said section being transversely disposed relative to said first and second panels when the reel is sandwiched therebetween.

4. The support of claim 1 wherein said struck-out elements are disposed in angularly spaced relation and each struck-out element has a peripheral segment foldably connected to said first panel, said overlapping stacked struck-out elements having the peripheries thereof adapted to frictionally engage the reel hub opening when the reel is sandwiched between the panels.

5. The support of claim 1 wherein said struck-out elements are disposed in superposed substantially coincident relation when forming said protuberance.

6. The support of claim 4 wherein the first folded struck-out element forming the protuberance being provided with a peripheral recess accommodating the peripheral segment of the next struck-out element forming the protuberance.

7. The support of claim 6 wherein said first panel is provided with three symmetrically arranged struck-out elements; the first folded struck-out element forming the protuberance being provided with a pair of angularly spaced peripheral recesses accommodating the peripheral segments of the second and third folded struck-out elements forming the protuberance, and the second folded struck-out element being provided with a peripheral recess accommodating the peripheral segment of the third folded struck-out element.

8. The support of claim 4 wherein each overlapped struck-out element forming the protuberance being provided with at least one peripheral recess accommodating the peripheral segment of the adjacent overlapping struck-out element forming the protuberance, the number of peripheral recesses in a struck-out element corresponding to the number of struck-out elements overlapping same to form said protuberance.

* * * * *